US007457580B2

(12) United States Patent
Kitamura

(10) Patent No.: US 7,457,580 B2
(45) Date of Patent: Nov. 25, 2008

(54) SHEET SUPPLYING DEVICE AND IMAGE FORMING APPARATUS

(75) Inventor: Makoto Kitamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 169 days.

(21) Appl. No.: 11/158,134

(22) Filed: Jun. 21, 2005

(65) Prior Publication Data

US 2005/0286947 A1 Dec. 29, 2005

(51) Int. Cl.
*G03G 15/00* (2006.01)

(52) U.S. Cl. ..... 399/393; 399/388; 271/9.08; 271/126; 271/156; 271/160; 400/624

(58) Field of Classification Search ..... 399/361, 399/367, 371, 381, 388, 393, 395, 396; 271/3.08, 271/109, 126, 127, 9.08, 160, 219, 156, 157; 400/624, 627, 628
See application file for complete search history.

(56) References Cited

U.S. PATENT DOCUMENTS 5,915,690 A * 6/1999 Surya ..... 271/265.01
5,951,002 A * 9/1999 Yokota ..... 271/117
6,354,586 B1 * 3/2002 Samoto ..... 271/127
6,783,126 B2 * 8/2004 Amamoto ..... 271/152
2003/0116906 A1 * 6/2003 Amamoto ..... 271/126

FOREIGN PATENT DOCUMENTS

JP 2003-201045 A 7/2003

* cited by examiner

*Primary Examiner*—Ren Yan
*Assistant Examiner*—Andy L Pham
(74) *Attorney, Agent, or Firm*—Panitch Schwarze Belisario & Nadel LLP

(57) ABSTRACT

Printing sheets (4) are placed on a sheet placing plate (103). A pickup roller (6) contacts a surface of the uppermost printing sheet (4) placed on the sheet placing plate (103) and feeds the printing sheet (4) out of the sheet placing plate (103). A spring (109) resiliently urges the sheet placing plate (103) toward the pickup roller (6). A ratchet (108) moves in accordance with the movement of the sheet placing plate (103). The printing sheets (4) on the sheet placing plate (103) urges the pickup roller (6) upward so that a pickup frame (115) moves upward to a position detected by a position detecting sensor (65). In accordance with the detection signal from the position detecting sensor (65), a solenoid (71) moves a lock lever (110) so that the lock lever (110) engages the ratchet (108) to thereby restrict the movement of the sheet placing plate (103).

14 Claims, 10 Drawing Sheets

SHEET SUPPLYING DEVICE AND IMAGE FORMING APPARATUS

BACKGROUND OF THE INVENTION

This invention relates to an image forming apparatus such as a copier, a facsimile and a printer that forms an image on a printing sheet. This invention also relates to a sheet supplying device including a sheet tray detachably attached to the image forming apparatus and a mechanism for supplying each of printing sheets stored in the sheet tray to the image forming apparatus.

There is known a sheet supplying device having a sheet placing member on which printing sheets are stacked. The sheet placing member is movable upward and downward between a sheet supplying position (in which the uppermost printing sheet contacts a pickup roller) and a retracting position. The conventional sheet supplying device has a lifter for moving the sheet placing member. The lifter is driven by a motor, and the driving force of the motor is transmitted to the lifter by means of an idle gear, a planetary gear and a lifter gear. Such a sheet supplying device is disclosed in, for example, Japanese Laid-Open Patent Publication No. 2003-201045 (Page 6 and FIG. 7).

However, in the conventional sheet supplying device of the image forming apparatus, it is necessary to provide a lot of gears, a driving motor, a controlling circuit for controlling the driving motor and other components for moving the lifter. Thus, the number of the components may increase, and therefore the size of the sheet supplying device may become large, and the manufacturing cost of the sheet supplying device may increase.

SUMMARY OF THE INVENTION

An object of the present invention is to provide a sheet supplying device and an image forming apparatus having a simple structure and being capable of reducing a manufacturing cost thereof without loss of function.

The present invention provides a sheet supplying device including a main body, and a sheet placing member on which printing sheets are placed. The sheet placing member is supported by the main body so that the sheet placing member is able to move upward and downward. A feeding unit is movably supported by the main body. The feeding unit contacts a surface of the printing sheet on the sheet placing member and moves to feed the printing sheet out of the sheet placing member. An urging member is supported by the main body. The urging member resiliently urges the sheet placing member upward toward the feeding unit. A driven unit moves in accordance with the movement of the sheet placing member. An engaging unit is movably supported by the main body. The engaging unit engages the driven unit to restrict the movement of the driven unit, so as to restrict the movement of the sheet placing member. A movement control unit moves the engaging unit according to the position of the feeding unit and controls the engagement unit so that the engaging unit engages and disengages from the driven unit.

The present invention also provides an image forming apparatus including the above described sheet supplying device and an image forming unit that forms an image on a printing sheet supplied by the sheet supplying device.

With such an arrangement, it becomes possible to provide a sheet supplying device and an image forming apparatus capable of surely performs a supplying operation of printing sheets with a simple structure and without using a motor as a driving source.

DETAILED DESCRIPTION OF THE PREFERRED EMBODIMENT

Embodiments of the present invention will be described with reference to the attached drawings.

Embodiment 1

Figure 1:
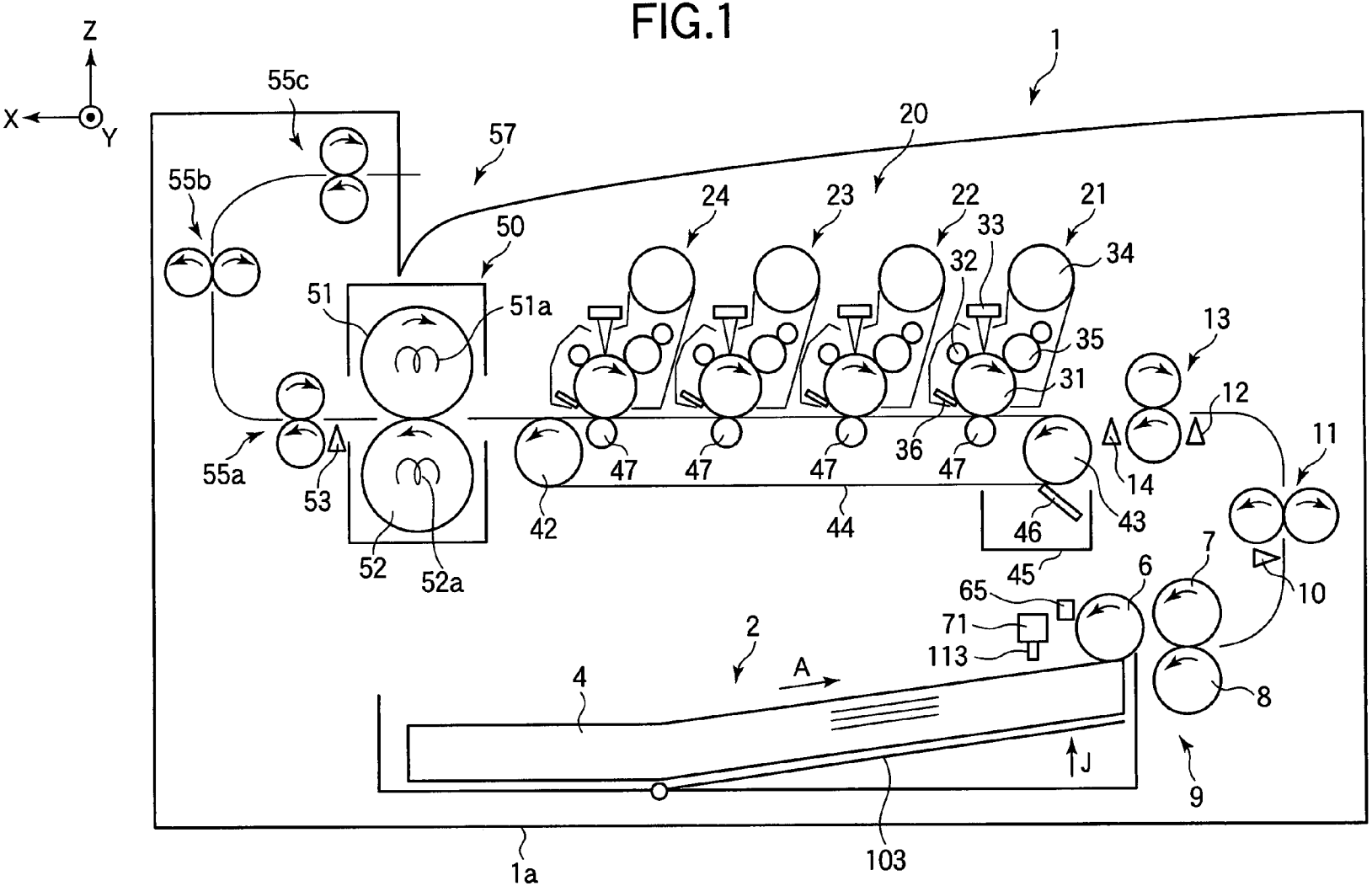
FIG. 1 shows a structure of a main part of an image forming apparatus including a sheet supplying device according to Embodiment 1 of the present invention.

FIG. 1 shows a structure of a main part of an image forming apparatus including a sheet supplying device according to Embodiment 1 of the present invention.

As shown in FIG. 1, a sheet tray 2 in which printing sheets 4 are stacked is detachably attached to a main body 1*a* of an image forming apparatus 1. A sheet placing plate 103 is provided in the sheet tray 2, and is rotatably supported by a not shown support shaft in the sheet tray 2. The printing sheets 4 are stacked on the sheet placing plate 103. The structure of the sheet tray 2 will be described later.

The sheet placing plate 103 rotates in the direction shown by an arrow J in FIG. 1 so that the uppermost printing sheet 4 contacts a pickup roller 6. A pair of rollers (i.e., a feed roller 7 and a retard roller 8) are provided on the downstream side of the pickup roller 6, and the feed roller 7 and the retard roller 8 contact each other. The pickup roller 6, the feed roller 7 and the retard roller 8 constitute a sheet feeding portion (i.e., a feeding unit) 9. The pickup roller 6 and the feed roller 7 are driven by a not shown rotation driving mechanism and respectively rotate in directions shown by arrows in FIG. 1. The retard roller 8 is driven by a not shown torque generating mechanism and generates a torque in the direction shown by an arrow in FIG. 1. The pickup roller 6 contacts the printing sheet 4 and draws the printing sheet 4 out of the sheet tray 2. Even when a plurality of printing sheets 4 are simultaneously fed by the pickup roller 6, the feed roller 7 and the retard roller 8 separate the printing sheet 4 and feed the printing sheet 4 one by one into a sheet carrying path. The operation of the sheet feeding portion 9 is controlled by a sheet feeding controller 67 (FIG. 2) as described later.

Figure 2:
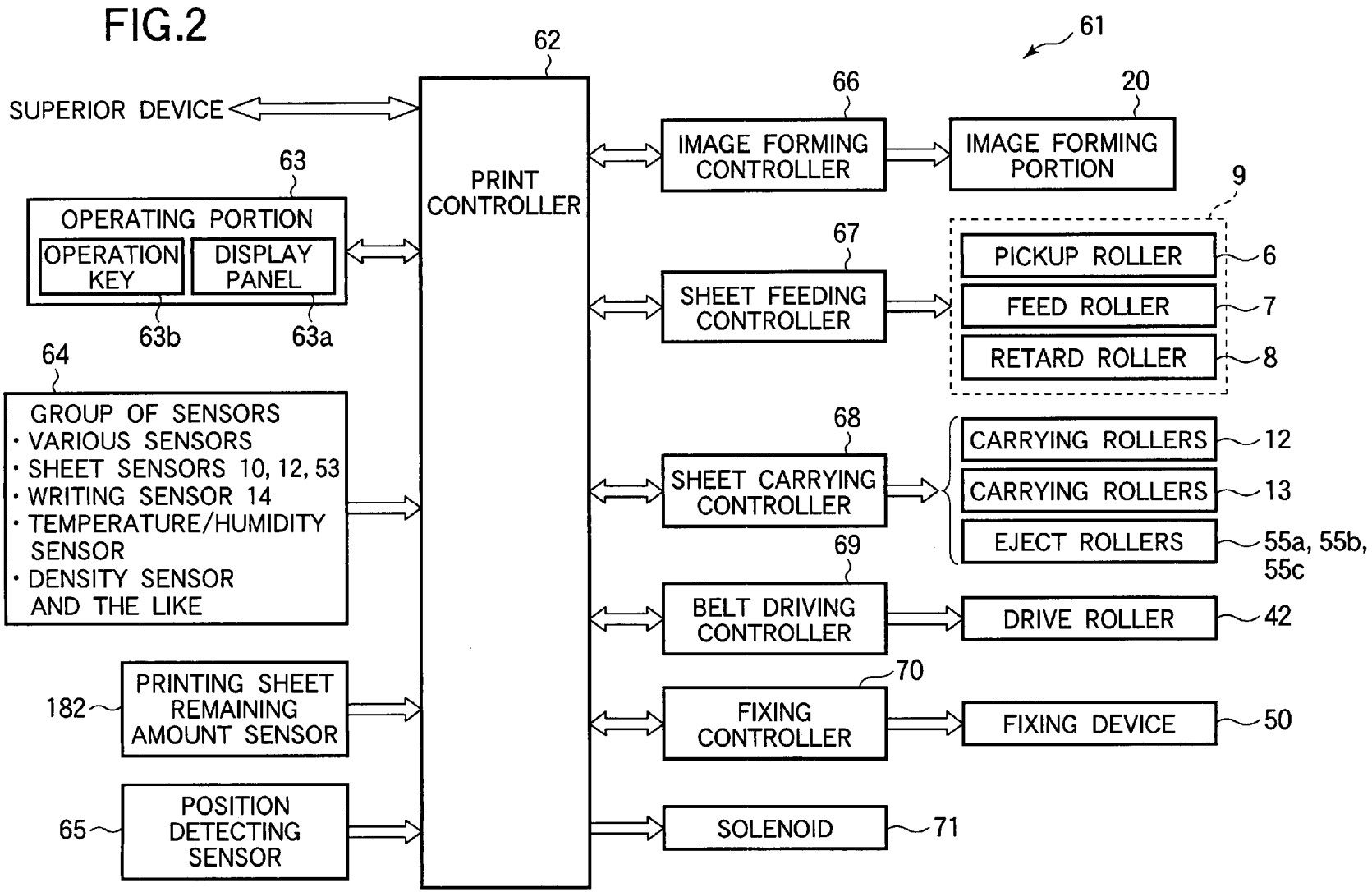
FIG. 2 is a block diagram showing a controlling system of the main part of the image forming apparatus according to Embodiment 1 of the present invention.

On the downstream side of the sheet feeding portion 9, a sheet sensor 10, a pair of carrying rollers 11, another sheet sensor 12, another pair of carrying rollers 13, and a writing sensor 14 are disposed in this order along the carrying direction of the printing sheet 4. The carrying rollers 11 correct the skew of the printing sheet 4. The sheet sensor 12 detects a timing to start rotating the carrying rollers 13. The carrying rollers 13 carry the printing sheet 4 to an image forming portion 20. The writing sensor 14 is used to detect a timing to start writing in the image forming portion 20. A driving force is generated by a not shown driving source and is transmitted to the carrying rollers 11 and 13 by means of gears or the like. The rotations of the carrying rollers 11 and 13 are controlled by a sheet carrying controller 68 (FIG. 2).

The image forming portion (i.e., an image forming unit) 20 includes four detachable process units 21 through 24 that respectively form images of respective colors on the recording sheet 4. The process units 21 through 24 are arranged in this order along the carrying path of the printing sheet 4 from the upstream to the downstream. The process units 21 through 24 have the same internal structures, and therefore the internal structure of the yellow process unit 21 will be described.

The process unit 21 has a photosensitive drum 31 rotatable in the direction shown by an arrow in FIG. 1. Along the circumference of the photosensitive drum 31, a charging roller 32, an exposing device 33, a developing roller 35 and a cleaning blade 36 are arranged in this order along the rotational direction of the photosensitive drum 31. The charging roller 32 electrically charges the surface of the photosensitive drum 31. The exposing device 33 selectively exposes the surface of the photosensitive drum 31 with light to form a latent image on the surface of the photosensitive drum 31. The developing roller 35 supplies the yellow toner to the surface of the photosensitive drum 31, so as to develop the latent image. The cleaning blade 36 removes the residual toner that remains on the photosensitive drum 31 after the developed toner image is transferred to the printing sheet 4. A toner storing portion 34 stores the toner and supplies the toner to the developing roller 35. A driving force is generated by a not shown driving source, and is transmitted to the photosensitive drum 35 and other rotating members by means of gears or the like.

Transfer rollers 47 (made of conductive rubber or the like) are respectively provided in opposition to the photosensitive drums 31 of the process units 21 through 24. The transfer rollers 47 are urged against the photosensitive drums 31 via a transfer belt 44. Electric potentials are applied to the photosensitive drum 31 and the transfer roller 47 so as to generate a difference in electric potential between the surfaces of the photosensitive drum 31 and the transfer roller 47, for transferring the toner image from the photosensitive drum 31 to the printing sheet 4. The rotations of the components of the image forming portion 20 and the application of the voltages to the components of the image forming portion 20 are controlled by an image forming controller 66 (FIG. 2) described later.

The transfer belt 44 absorbs the printing sheet 4 with an electrostatic force and carries the printing sheet 4. The transfer belt 44 is stretched around a drive roller 42 and a tension roller 43. The drive roller 42 and the tension roller 43 move the transfer belt 44. A cleaning blade 46 scrapes off the toner adhering to the transfer belt 44, to thereby cleans the transfer belt 44. A toner box 45 stores the accumulated toner scraped off from the transfer belt 44. A driving force is generated by a not shown driving source, and is transmitted to the drive roller 42 by means of gears or the like. The rotation of the drive roller 42 is controlled by a belt driving controller 69 (FIG. 2) described later.

The fixing device 50 includes a pair of rollers, i.e., an upper roller 51 and a lower roller 52. The upper roller 51 has a halogen lamp 51*a* as an internal heat source and a surface layer made of resilient material. The lower roller 52 has a halogen lamp 52*a* as an internal heat source and a surface layer made of resilient material. The fixing device 50 applies heat and pressure to the toner image on the printing sheet 4 carried from the image forming portion 20 so that the toner is molten and fixed to the printing sheet 4. The operation of the fixing device 50 is controlled by a fixing controller 70 (FIG. 2) described later. After the image is fixed to the printing sheet 4, the printing sheet 4 is carried by eject rollers 55*a*, 55*b* and 55*c*, and ejected to a stacker portion 57 on the exterior of the image forming apparatus 1. A driving force is generated by a not shown driving source, and is transmitted to the eject rollers 55*a*, 55*b* and 55*c* by means of gears or the like. The rotations of the eject rollers 55*a*, 55*b* and 55*c* are controlled by the sheet carrying controller 68 (FIG. 2) described later. The sheet sensor 53 is provided at an eject side of the fixing device 50, and detects the timing to drive the eject rollers 55*a*, 55*b* and 55*c*.

The image forming apparatus 1 includes a solenoid 71, a plunger 113 and a position detecting sensor 65 respectively operated in accordance with the movement of the sheet tray 2. The solenoid 71, the plunger 113 and the position detecting sensor 65 will be described later in detail.

FIG. 2 is a block diagram showing a control system of the main part of the image forming apparatus 1 according to Embodiment 1 of the present invention. The control system will be described with reference to FIG. 1.

In FIG. 2, a print controller 62 includes a microprocessor, a ROM, a RAM, an Input/Output port, a timer or the like. The print controller 62 receives a print data and a control command from a superior device, and controls the whole sequence of the image forming apparatus 1 (FIG. 1) to perform a print operation.

An operating portion 63 has a display panel 63*a* for displaying a condition of the image forming apparatus 1, an operation key 63*b* for sending command from an operator to the image forming apparatus 1, and the like. A group of sensors 64 includes various sensors for monitoring the condition of the image forming apparatus 1 such as the sheet sensors 10, 12 and 53 (FIG. 1), the writing sensor 14 (FIG. 1), a temperature and humidity sensor, a density sensor (not shown), and the like.

The image forming controller 66 controls the respective operations of the image forming portion 20, for example, the rotations of the photosensitive drums 31, the exposure of the exposing devices 33 or the like of the process units 21 through 24, in accordance with the instruction from the print controller 62. The sheet feeding controller 67 controls the rotations of the pickup roller 6 and the feed roller 7 and the torque generated by the retard roller 8, in accordance with the instruction from the print controller 62. The sheet carrying controller 68 controls the rotations of the carrying rollers 11 and 13 and the eject rollers 55*a*, 55*b* and 55*c*, in accordance with the instruction from the print controller 62. The belt driving controller 69 controls the rotation of the drive roller 42 for moving the transfer belt 44, in accordance with the instruction from the print controller 62. The fixing controller 70 includes driving sources of the upper roller 51 and the lower roller 52, power sources of the halogen lamps 52*a* and 53*a*, and the like. The fixing controller 70 controls the rotations the upper roller 51 and the lower roller 52 and the heating of the halogen lamps 51*a* and 52*a*, in accordance with the instruction from the print controller 62. The position detecting sensor 65 and the solenoid 71 will be described later.

The operation of the above constructed image forming apparatus 1 will be described below. The sheet supplying operation performed by the sheet tray 2 and the sheet feeding portion 9 will be described later in detail.

First, the sheet feeding portion 9 (i.e., the pickup roller 6, the feed roller 7 and the retard roller 8) feeds the printing sheet 4 of the sheet tray 2 one by one (starting with the uppermost printing sheet 4) into the sheet carrying path. The printing sheet 4 passes through the sheet sensor 10 and reaches the carrying rollers 11. The carrying rollers 11 start carrying the printing sheet 4 at a predetermined timing in accordance with a timing when the sheet sensor 10 detects the passage of the printing sheet 4. For example, the carrying rollers 11 start rotating when a predetermined time has elapsed after the printing sheet 4 contacts the carrying rollers 11, so as to correct the skew of the printing sheet 4 when the printing sheet 4 is nipped by the carrying rollers 11.

The printing sheet 4 carried by the carrying rollers 11 passes the sheet sensor 12, and reaches the carrying rollers 13. The carrying rollers 13 start rotating when the printing sheet 4 passes the sheet sensor 12, so that the carrying rollers 13 carry the printing sheet 4 toward the image forming portion 20 without stopping the printing sheet 4. The printing sheet 4 carried by the carrying rollers 13 passes the writing sensor 14, and reaches the image forming portion 20.

In the image forming portion 20, the printing sheet 4 is carried by the transfer belt 44, and reaches the nip portion between the photosensitive drum 31 and the transfer roller 47 of the process unit 21. Then, the printing sheet 4 is nipped by the photosensitive drum 31 and the transfer roller 47, and the toner image is transferred from the photosensitive drum 31 to the printing sheet 4.

In the process units 22 through 24, the latent images are formed on the photosensitive drums 31, and developed by the developing rollers 35, so that the toner images of the respective colors are formed on the photosensitive drums 31. As the printing sheet 4 passes the process units 22 through 24, the toner images of the respective colors are sequentially transferred to the printing sheet 4 so that the toner images overlaps with each other. After the toner images of the respective colors are transferred to the printing sheet 4, the toner images are fixed to the printing sheet 4 by the fixing device 50. Then, the printing sheet 4 is ejected by the eject rollers 55*a*, 55*b* and 55*c* to the stacker portion 57 on the exterior of the image forming apparatus 1. With such a process, the printing of the color image on the printing sheet 4 is completed.

X-axis, Y-axis and Z-axis are shown in FIG. 1. X-axis is defined in the direction in which the printing sheet 4 is carried through the process units 21 through 24. Y-axis is defined in the direction of the rotation axis of the photosensitive drum 31. Z-axis is defined to be perpendicular to both of the X-axis and Y-axis. In other figures in which X-axis, Y-axis and Z-axis are shown, X-axis, Y-axis and Z-axis indicate the same directions as those described with reference to FIG. 1.

Figure 3:
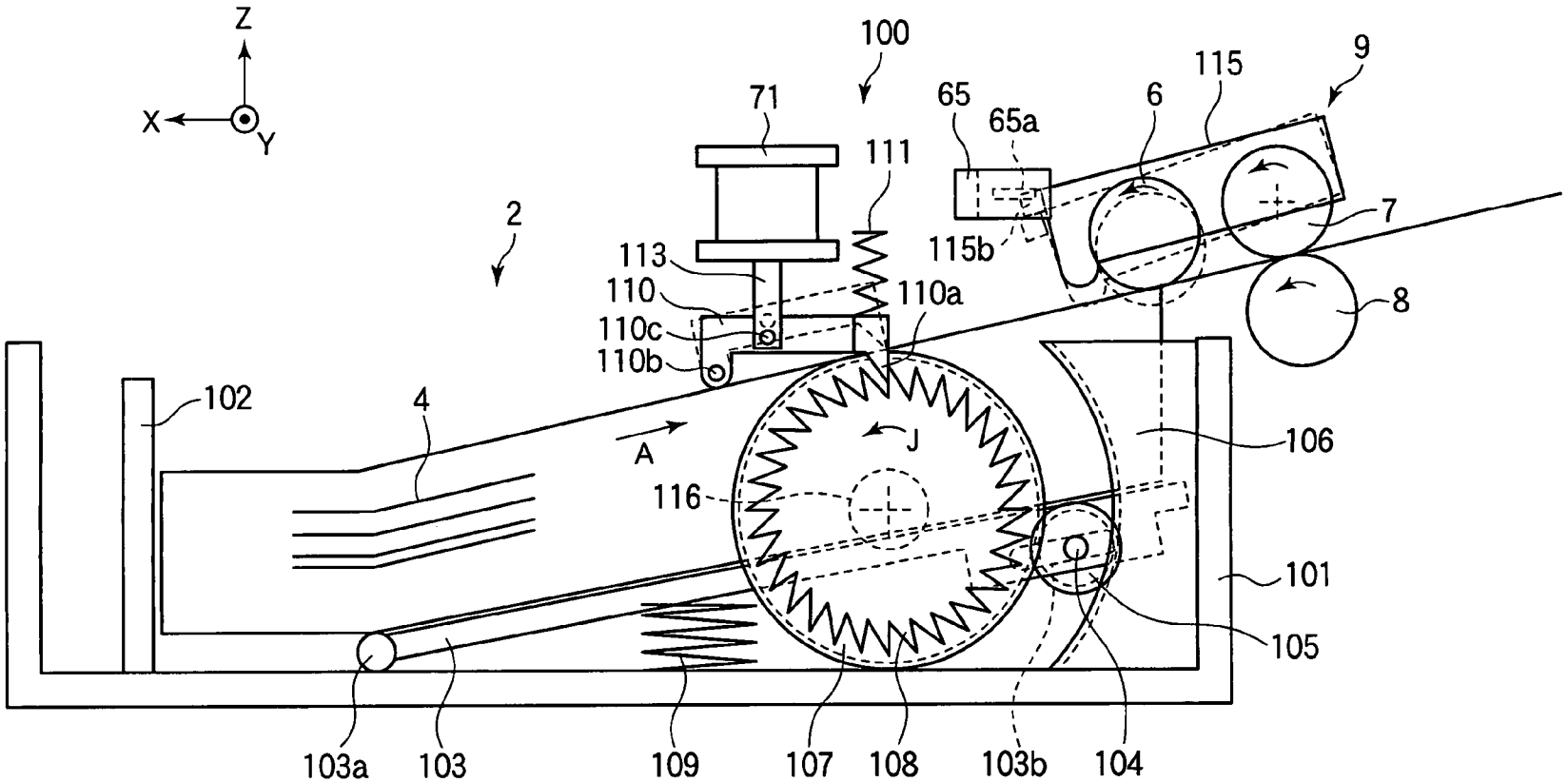
FIG. 3 is a side view showing the structure of the main part of the sheet supplying device according to Embodiment 1 of the present invention, corresponding to an enlarged view of a sheet tray and a sheet feeding portion of the image forming apparatus shown in FIG. 1.
Figure 4:
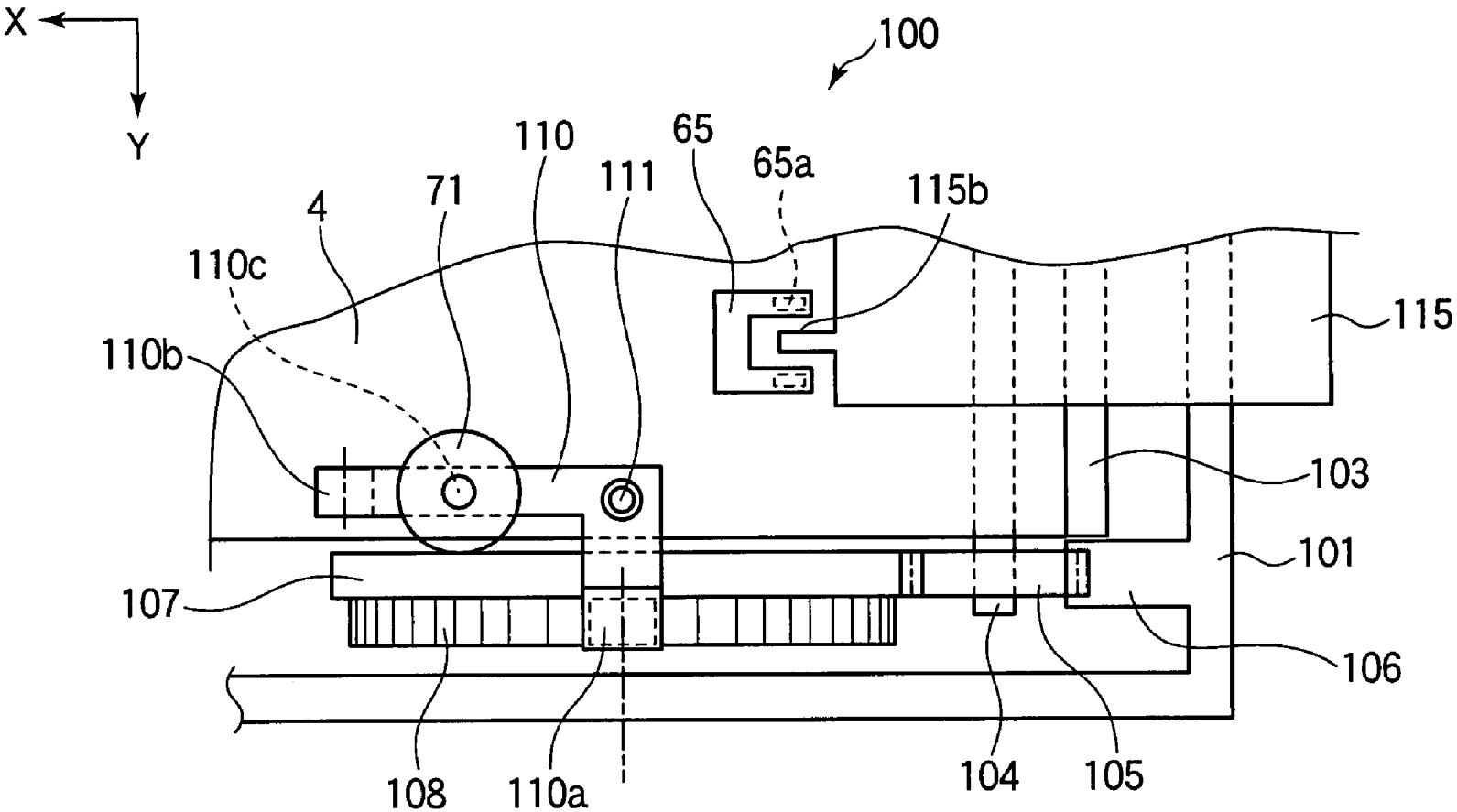
FIG. 4 is a top view showing the structure of the main part of the sheet supplying device as seen in the direction of Z-axis.

FIG. 3 is a side view showing the structure of the main part of the sheet supplying device 100 according to Embodiment 1 of the present invention, corresponding to the enlarged view of the sheet tray 2 and the sheet feeding portion 9 of the image forming apparatus 1 shown in FIG. 1. FIG. 4 is a top view of the main part of the sheet supplying device 100 as seen from above in the direction of Z-axis.

As shown in FIG. 3, the sheet tray 2 has a sheet storing portion surrounded by a tray frame 101 attached to the main body 1*a* (FIG. 1) of the image forming apparatus 1. Side guide members (not shown) are provided in the tray frame 101, which defines both side ends of the printing sheet 4. A rear guide member 102 is provided in the tray frame 101, which defines the rear end of the printing sheet 4 in the feeding direction A of the printing sheet 4. A sheet placing plate 103 is provided in the tray frame 101. A majority part of the printing sheet 4 on the front part (in the feeding direction A) is placed on the sheet placing plate 103. The sheet placing plate 103 is rotatably supported by the tray frame 101, by means of a support shaft 103*a* (i.e., a rotation shaft) provided on the rear end of the sheet placing plate 103, i.e., an end in the positive direction of X-axis. A pair of elongated holes 103*b* are formed on the lower parts in the vicinity of the front end of the sheet placing plate 103 (i.e., an end portion in the negative direction of X-axis). The elongated holes 103*b* receive a shaft 104 extending along Y-axis so that the shaft 104 is slidable in the feeding direction A of the printing sheet. Planetary gears 105 are fixed to both ends of the shaft 104.

Internally-toothed racks 106 are provided on a front part of the tray frame 101 in the feeding direction A so that the racks 106 respectively face and engage the planetary gears 105. A sun gear (i.e., a movable member) 107 is rotatably provided on the positive side (in the direction of Y-axis) of the tray frame 101 so that the sun gear 107 faces and engages the planetary gear 105. The sun gear 107 is provided with a torque generator (i.e., a load generating unit) 116 that generates a predetermined load torque when the sun gear 107 rotates in the direction shown by the arrow J in FIG. 3. A ratchet (i.e., a driven unit) 108 is coaxial with the sun gear 107 and rotate together with the sun gear 107. The ratchet 108 has a plurality of pawls (i.e., convexes and concaves) arranged on a circumference of a circle having a common center with the ratchet 108. A spring (i.e., an urging member) 109 is provided between the sheet placing plate 103 and the tray frame 101 for urging the front end portion (in the feeding direction A) of the sheet placing plate 103 upward.

Further, a lock lever (i.e., an engaging unit) 110 is supported by the tray frame 101 so that the lock lever 110 is rotatable about a shaft 110*b*. A claw 110*a* is formed on the tip of the lock lever 110, and is urged by a spring 111 in the direction in which the claw 110*a* engages the ratchet 108. In a normal condition, the claw 110*a* of the lock lever 110 engages the ratchet 108. The center portion of the lock lever 110 is connected to a plunger 113 of the solenoid 71 provided on the main body 1*a* (FIG. 1) of the image forming apparatus 1. The solenoid 71 pulls the plunger 113 upward, i.e., in the positive direction of Z-axis. In a state where the tray 2 is detached from the image forming apparatus 1, the connection between the plunger 113 and the lock lever 110 is released. The solenoid 71 with the plunger 113 (i.e., a plunger solenoid), the position detecting sensor 65 and the print controller 62 constitute a movement control unit.

A pickup roller 6 of the sheet feeding portion 9 is provided on the main body 1*a* (FIG. 1) of the image forming apparatus 1. The pickup roller 6 is so disposed that the pickup roller 6 contacts the uppermost printing sheet 4 (placed on the sheet placing plate 103 of the sheet tray 2) at the front end of the printing sheet 4 in the feeding direction A. The pickup roller 6 is rotatably supported by a pickup frame 115. The pickup frame 115 is rotatably supported by a shaft which is coaxial with, for example, a rotation shaft of the feed roller 7. Thus, the pickup roller 6 and the pickup frame 115 can be located as shown by a dashed line in FIG. 3. When the sheet feeding portion 9 (i.e., the pickup roller 6, the feed roller 7 and the retard roller 8) feeds the printing sheet 4, the pickup roller 6 and the retard roller 8 are controlled to rotate in the directions indicated by the arrows in FIG. 3, and the retard roller 8 is controlled to generate a predetermined torque in the direction shown by the arrow in FIG. 3. The pickup frame 115 is constructed to urge the pickup roller 6 against the uppermost printing sheet 4 by means of its own weight or an urging member.

As shown in FIG. 4, the position detecting sensor 65 has a detecting portion 65*a* that detects a detectable portion 115*b* of the pickup frame 115 (when the detectable portion 115*b* is in a position to be detected by the detecting portion 65*a*), and outputs an information signal to the print controller 62 (FIG. 2). In accordance with the information signal as described later, in a state where the position detecting sensor 65 does not detect the pickup frame 115 (for example, in a state where the pickup frame 115 positions as shown by the dashed line in FIG. 3), the print controller 62 drives the solenoid 71 to pull the plunger 113 upward, so that the lock lever 110 rotates to a lock-release position indicated by the dashed line in FIG. 3. Conversely, in a state where the solenoid 71 does not pull the plunger 113, the plunger 113 becomes free to move, and therefore the lock lever 110 is urged by the spring 111 to rotate to a lock position as shown by a solid line in FIG. 3.

The operation of the above constructed sheet supplying device 100 will be described.

When the sheet tray 2 (in which the printing sheets 4 are stored) is attached to the image forming apparatus 1, a not shown lock release mechanism releases the lock of the sheet placing plate 103 which holds the sheet placing plate 103 at the lowest position. In this state, the pickup frame 115 and the lock lever 110 are located as shown by the dashed line in FIG. 3. Then, the engagement between the lock lever 110 and the ratchet 108 is released (i.e., the lock lever 110 is in the lock-release position). With this, the sheet placing plate 103 starts rotating upward by the force of the spring 109, so that the planetary gear 105 rotates and moves upward in engagement with the internally-toothed rack 106, causing the sun gear 107 to rotate in the direction shown by the arrow J in FIG. 3.

Further, when the sheet placing plate 103 moves upward, the uppermost printing sheet 4 contacts the pickup roller 6 and urges the pickup frame 115 upward. When the position detecting sensor 65 detects the pickup frame 115 that have moved upward, the print controller 62 (FIG. 2) stops driving the solenoid 71. Then, the plunger 113 becomes free to move, and therefore the lock lever 110 rotates counterclockwise to the lock position shown by the solid line in FIG. 3 by the force of the spring 111.

By the rotation of the lock lever 110, the claw 111*a* of the lock lever 110 engages the ratchet 108, so as to prevent the rotation of the sun gear 107 in the direction shown by the arrow J. Therefore, the rotation of the planetary gear 105 and the upward movement of the sheet placing plate 103 are stopped. Because the torque generator 116 provided on the sun gear 107 generates the load torque against the direction shown by the arrow J, the upward moving speed of the sheet placing plate 103 is gradually reduced, and therefore it is ensured that the lock lever 110 engages the ratchet 108.

During the printing operation of the image forming apparatus 1, the sheet feeding portion 9 feeds the printing sheets 4 out of the sheet tray 2, so that the amount of the printing sheets 4 stored in the sheet tray 2 decreases. With this, the detectable portion 115*b* of the pickup frame 115 moves downward, so that the position detecting sensor 65 becomes unable to detect the pickup frame 115. Thus, the print controller 62 (FIG. 2) drives the solenoid 71 to pull the plunger 113 upward, so that the lock lever 110 rotates to the lock release position. Therefore, the sheet placing plate 103 moves upward, so that the uppermost printing sheet 4 urges the pickup roller 6 (and the detectable portion 115*b* of the pickup frame 115) upward. When the position detecting sensor 65 detects the pickup frame 115 that have moved upward, the print controller 62 (FIG. 2) stop driving the solenoid 71. As a result, the plunger 113 becomes free to move, so that the lock lever 110 rotates to the lock position shown by the solid line in FIG. 3 by the force of the spring 111, to thereby stop the upward movement of the sheet placing plate 103.

As the image forming apparatus 1 continues the printing operation, the sheet placing plate 103 repeatedly moves upward and stops, in accordance with the rotation of the ratchet 108. Each upward movement of the sheet placing plate 103 corresponds to the rotation of the ratchet 108 by one pawl. As a result, the height of the printing sheet 4 being fed out of the sheet tray 2 is kept constant.

As described above, according to the sheet supplying device 100 of Embodiment 1, the sheet placing plate 103 repeatedly moves upward and stops by means of simple arrangement (i.e., the plunger 113, the solenoid 71, the springs 109 and 111, the planetary gears 105, the ratchet 108, and the lock lever 110) without using a lot of gears, an exclusive motor, a driving circuit for the motor, or the like. Therefore, the electric power consumption can be reduced, and the structure of the sheet supplying device 100 can be simplified. Thus, the size and the manufacturing cost of the sheet supplying device 100 (and therefore the image forming apparatus 1) can be reduced.

Embodiment 2

Figure 5:
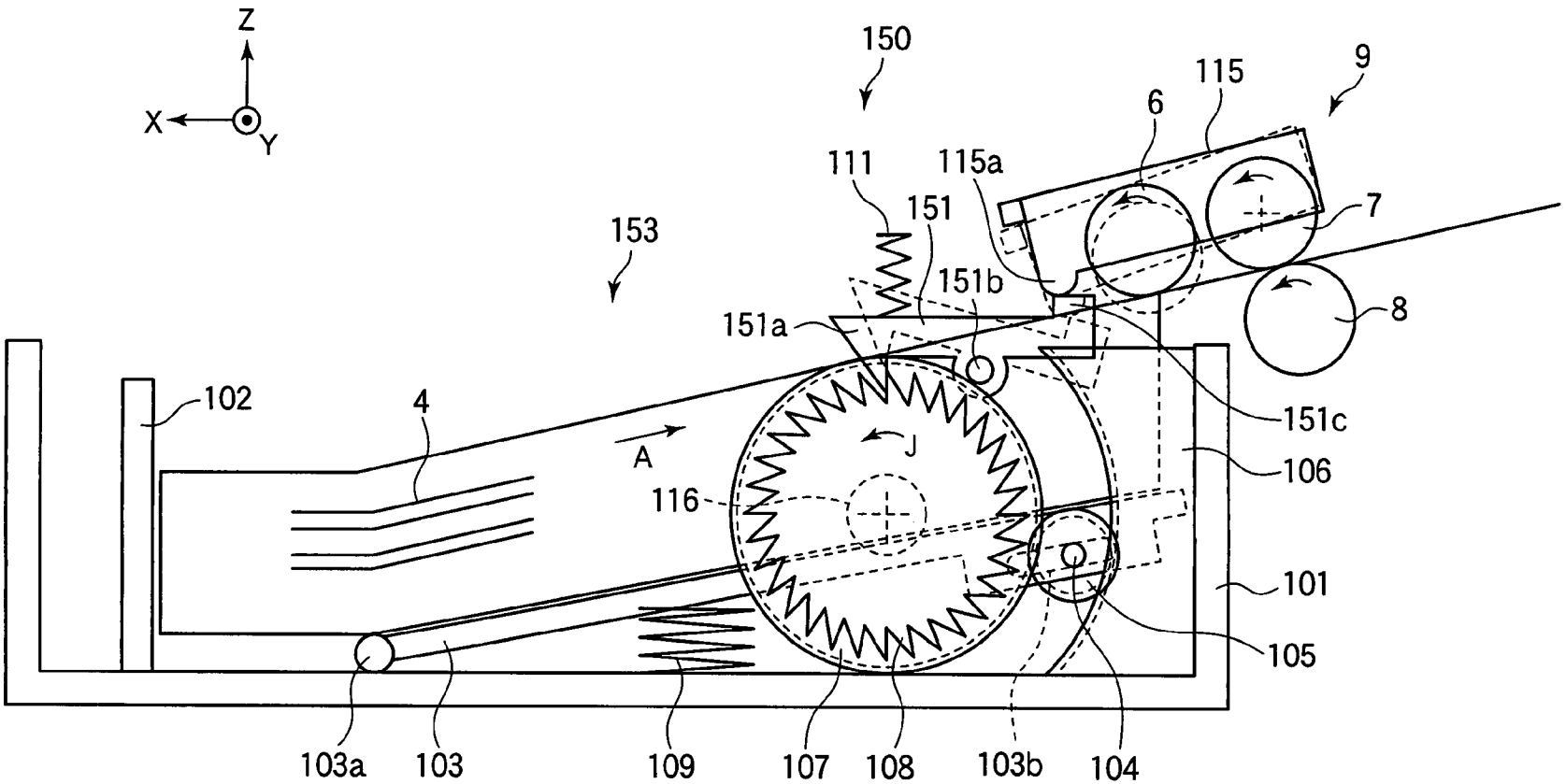
FIG. 5 is a side view showing a structure of a main part of a sheet supplying device according to Embodiment 2 of the present invention.
Figure 6:
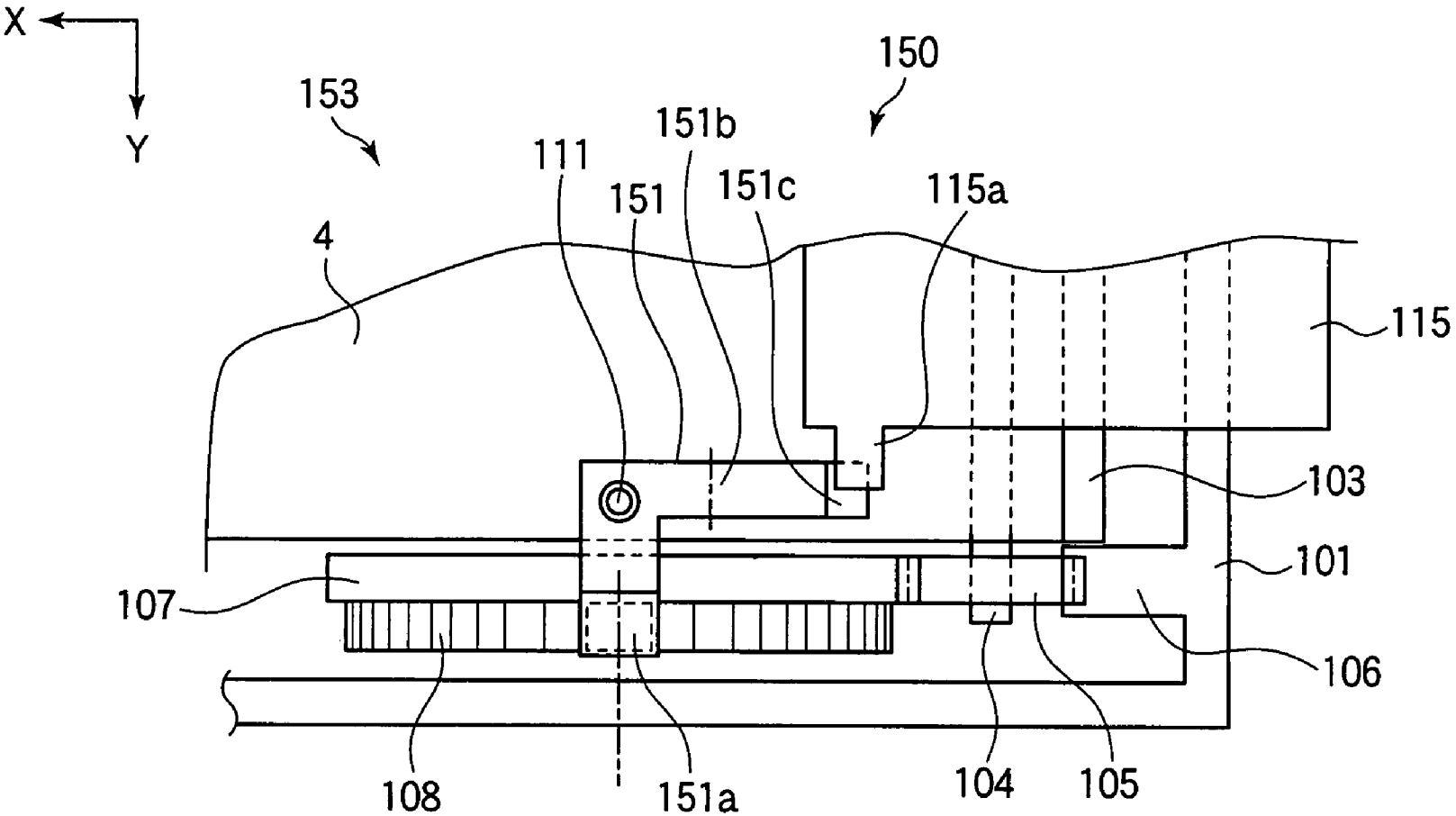
FIG. 6 is a top view showing the structure of the main part of the sheet supplying device according to Embodiment 2 as seen in the direction of Z-axis.

FIG. 5 is a side view showing a structure of a main part of the sheet supplying device 150 according to Embodiment 2 of the present invention. FIG. 6 is a top view of the main part of the sheet supplying device 150 seen from above in the direction of Z-axis.

The sheet supplying device 150 of Embodiment 3 is different from the sheet supplying device 100 of Embodiment 1 in the structure of a lock lever 151 provided in a sheet tray 153 and a mechanism for rotating the lock lever 151. The components of sheet supplying device 150 that are the same as those of the sheet supplying device 100 of Embodiment 1 (FIG. 3) are assigned the same reference numerals, and the duplicate explanation is omitted. The description is emphasized on the difference between the sheet supplying devices 100 and 150.

As shown in FIG. 5, the lock lever 151 (i.e., a rotatable member) has a shaft 151*b* rotatably supported by the tray frame 101. A claw 151*a* is formed on the end portion of the lock lever 151. In accordance with the rotation of the lock lever 151, the claw 151*a* is able to engage the ratchet 108 and disengage from the ratchet 108. Further, a contact portion 151*c* is provided on another end (opposite to the claw 151*a*) of the lock lever 151. The contact portion 151*c* is able to contact a pressing portion 115*a* formed on the pickup frame 115. The lock lever 151 is urged by the spring 111 in the direction in which the claw 151*a* engages the ratchet 108.

The operation of the above constructed sheet supplying device 150 will be described below.

The sheet tray 153 (FIG. 5) is mounted on the image forming apparatus 1 (FIG. 1) instead of the above described sheet tray 2 (FIG. 3). In this case, it is not necessary to provide the above described solenoid 71, the plunger 113, the position detecting sensor 65, and the controlling unit for controlling the solenoid 71 and the position detecting sensor 65 (FIG. 2).

When the sheet tray 153 is attached to the image forming apparatus 1 (FIG. 1), a not shown lock release mechanism releases the lock of the sheet placing plate 103 which holds the sheet placing plate 103 at the lowest position. In this state, the pressing portion 115*a* of the pickup frame 115 is pushing the contact portion 151*c* of the lock lever 151 downward, and the lock lever 151 is in the lock release position indicated by a dashed line in FIG. 5, resisting the force of the spring 111. The strength of the spring 111 is so set that the lock lever 151 rotates to a lock release position when the pickup frame 115 presses the contact portion 151*c* of the lock lever 151 downward by means of its own weight or a not shown urging mechanism.

The sheet placing plate 103 starts rotating upward by the force of the spring 109, so that the planetary gear 105 rotates and moves upward in engagement with the internally-toothed rack 106, causing the sun gear 107 to rotate in the direction shown by the arrow J in FIG. 5.

Further, when the sheet placing plate 103 moves upward, the uppermost printing sheet 4 contacts the pickup roller 6 (located as shown by a dashed line in FIG. 5) upward, so that the pressing portion 115*a* of the pickup frame 115 moves upward. As the pressing portion 115*a* moves upward, the lock lever 151 rotates counterclockwise from the lock release position (indicated by the dashed line) to the lock position in which the claw 151*a* engages the ratchet 108, so as to prevent the rotation of the sun gear 107 in the direction J. Therefore, the rotation of the planetary gear 105 and the upward movement of the sheet placing plate 103 are stopped. Because the torque generator 116 provided on the sun gear 107 generates the load torque against the direction shown by the arrow J, the upward moving speed of the sheet placing plate 103 is gradually reduced, and therefore it is ensured that the lock lever 151 engages the ratchet 108.

During the printing operation of the image forming apparatus 1, the sheet feeding portion 9 feeds the printing sheets 4 out of the sheet tray 153, so that the amount of the printing sheets 4 stored in the sheet tray 153 decreases. With this, the pressing portion 115*a* of the pickup frame 115 moves downward, so that the lock lever 151 rotates clockwise to the lock release position indicated by the dashed line in FIG. 5. Thus, the sheet placing plate 103 moves upward, so that the uppermost printing sheet 4 urges the pickup roller 6 (and the pressing portion 115*a* of the pickup frame 115) upward. As a result, the lock lever 151 rotates counterclockwise from the lock release position shown by the dashed line to the lock position shown by the solid line, to thereby stop the upward movement of the sheet placing plate 103.

As the image forming apparatus 1 continues the printing operation, the sheet placing plate 103 repeatedly moves upward and stops, in accordance with the rotation of the ratchet 108. Each upward movement of the sheet placing plate 103 corresponds to the rotation of the ratchet 108 by one pawl. As a result, the height of the printing sheet 4 being fed out of the sheet tray 153 is kept constant.

As described above, according to the sheet supplying device 150 of Embodiment 2, the sheet placing plate 103 repeatedly moves upward and stops by means of simple mechanism (i.e., the springs 109 and 111, the planetary gears 105, the ratchet 108, the lock lever 151) without using a lot of gears, an exclusive motor, a driving circuit for the motor, or the like. Additionally, it is not necessary to provide the plunger, the solenoid and the position detecting sensor described in Embodiment 1. Therefore, the electric power consumption can be further reduced, and the structure of the sheet supplying device 150 can be further simplified. Thus, the size and the manufacturing cost of the sheet supplying device 150 (and therefore the image forming apparatus 1) can be reduced.

Embodiment 3

Figure 7:
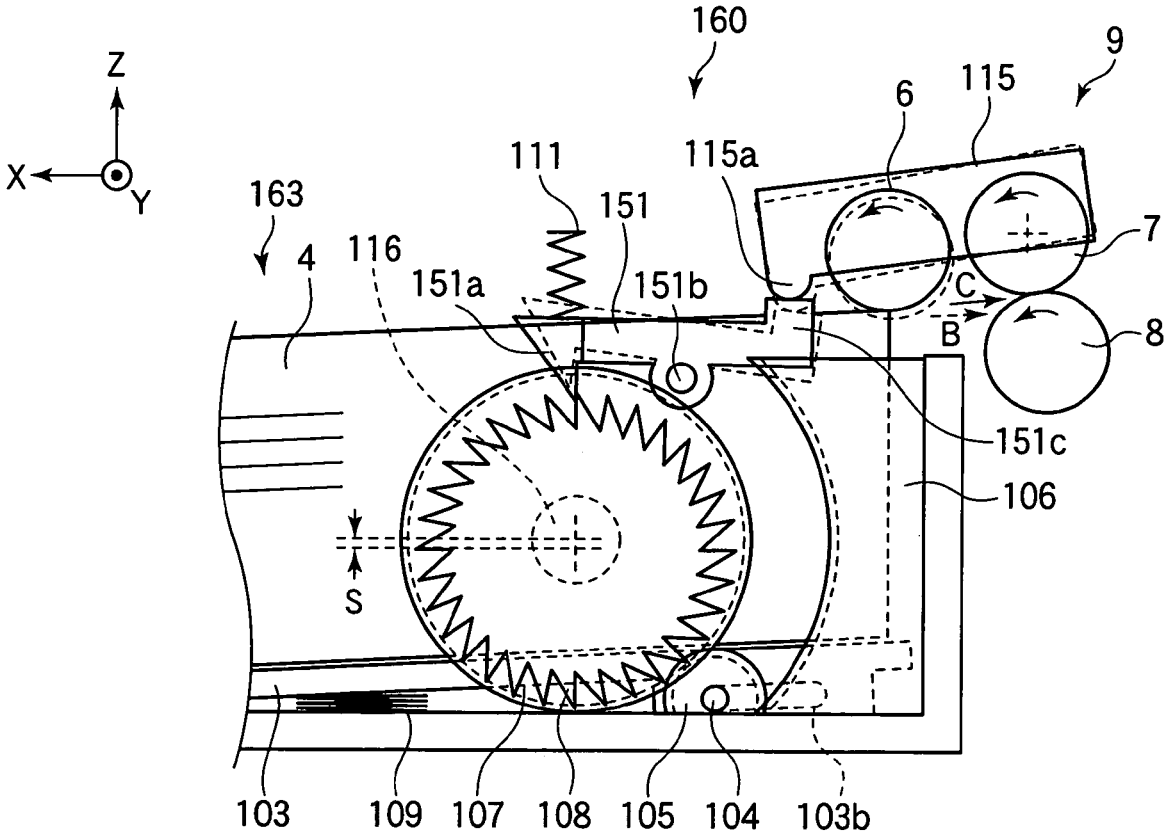
FIG. 7 is a side view showing a structure and an operation of a main part of a sheet supplying device according to Embodiment 3.
Figure 8:
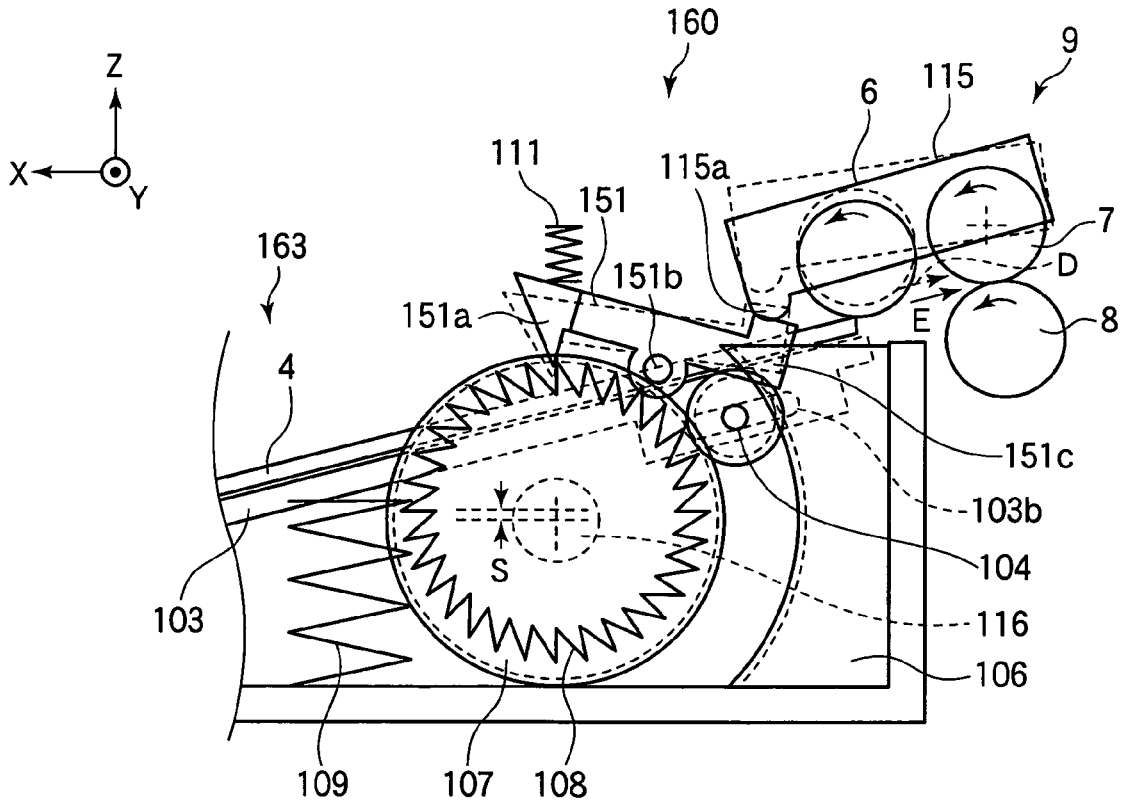
FIG. 8 is a side view showing the structure and the operation of the main part of the sheet supplying device according to Embodiment 3.

FIGS. 7 and 8 respectively show the structure and the operation of the main part of the sheet supplying device 160 according to Embodiment 3.

The sheet supplying device 160 of Embodiment 3 is different from the sheet supplying device 150 according to Embodiment 2 (FIG. 5) in that the center of the ratchet 108 is shifted from the center of the sun gear 107 by a distance S. The components of sheet supplying device 160 that are the same as those of the sheet supplying device 150 of Embodiment 2 (FIG. 5) are assigned the same reference numerals, and the duplicate explanation is omitted. The description is emphasized on the difference between the sheet supplying devices 150 and 160.

In the sheet supplying device 160, the center of the ratchet 108 becomes lower than the center of the sun gear 107 when the amount of the printing sheets 4 on a sheet tray 163 is the maximum as shown in FIG. 7. Conversely, the center of the ratchet 108 becomes higher than the center of the sun gear 107 when the amount of the printing sheets 4 on the sheet tray 163 is almost the minimum as shown in FIG. 8. The other structure of sheet supplying device 160 are the same as those of the sheet supplying device 150 of Embodiment 2, and therefore the duplicate explanation is omitted.

FIG. 7 shows a condition in which the amount of the printing sheets 4 on the sheet tray 163 is the maximum, and the center of the ratchet 108 becomes lower than the center of the sun gear 107. In this state, the rotational position of the lock lever 151 when the claw 151*a* engages the ratchet 108 (shown by a solid line) is displaced counterclockwise, with respect to the rotational position of the lock lever 151 when the claw 151*a* engages the ratchet 108 in the case where the centers of the ratchet 108 and the sun gear 107 are coaxial with each other (shown by a dashed line). In this state, the position where the pickup roller 6 contacts the printing sheet 4 (shown by a solid line) is higher than the position where the pickup roller 6 contacts the printing sheet 4 in the state where the centers of the sun gear 107 and the ratchet 108 are coaxial with each other (indicated by a dashed line).

FIG. 8 shows another condition in which the amount of the printing sheets 4 on the sheet tray 163 is almost the minimum, and the center of the ratchet 108 becomes higher than the center of the sun gear 107. In this state, the rotational position of the lock lever 151 when the claw 151*a* engages the ratchet 108 (shown by a solid line) is displaced clockwise, with respect to the rotational position of the lock lever 151 when the claw 151*a* engages the ratchet 108 in the case where the centers of the ratchet 108 and the sun gear 107 are coaxial with each other (shown by a dashed line). In this state, the position where the pickup roller 6 contacts the printing sheet 4 (shown by a solid line) is lower than the position where the pickup roller 6 contacts the printing sheet 4 when the centers of the sun gear 107 and the ratchet 108 are coaxial with each other (shown by a dashed line).

The feeding operation of the printing sheet 4 when the center of the sun gear 107 is coaxial with the center of the ratchet 108 will be described.

As shown in FIG. 7, when the amount of the printing sheets 4 on the sheet tray 163 is the maximum, the uppermost printing sheet 4 contacts the pickup roller 6 as shown by the dashed line in FIG. 7 and is fed out of the sheet tray 163. When the printing sheet 4 contacts the feed roller 7 and the retard roller 8, the tip of the printing sheet 4 may deviate downward as shown by an arrow B in FIG. 7. In contrast, as shown in FIG. 8, when the amount of the printing sheets 4 on the sheet tray 163 is almost the minimum, the uppermost printing sheet 4 contacts the pickup roller 6 as indicated by the dashed line in FIG. 8. When the printing sheet 4 contacts the feed roller 7 and the retard roller 8, the tip of the printing sheet 4 may deviates upward as shown by an arrow D in FIG. 8.

Next, the feeding operation of the printing sheet 4 when the center of the sun gear 107 is shifted from the center of the ratchet 108 (i.e., Embodiment 3) will be described.

As shown in FIG. 7, when the amount of the printing sheets 4 on the sheet tray 163 is the maximum, the uppermost printing sheet 4 contacts the pickup roller 6 as shown by the solid line in FIG. 7 and is fed out of the sheet tray 163. The printing sheet 4 is directed to the nip portion between the feed roller 7 and the retard roller 8 as shown by an arrow C in FIG. 7. As shown in FIG. 8, when the amount of the printing sheets 4 on the sheet tray 163 is almost the minimum, the uppermost printing sheet 4 contacts the pickup roller 6 as shown by the solid line in FIG. 8. The printing sheet 4 is directed to the nip portion between the feed roller 7 and the retard roller 8 as shown by an arrow E in FIG. 8.

As described above, because the centers of the ratchet 108 and the sun gear 107 are not coaxial with each other, the direction in which the printing sheet 4 is fed by the pickup roller 6 can be kept constant, irrespective of the amount of the printing sheets 4 on the sheet tray 163. In a particular example, it is ensured that the printing sheet 4 is directed toward the nip portion between the feed roller 7 and the retard roller 8.

As described above, according to the sheet supplying device 160 of Embodiment 3, the printing sheet 4 is directed toward the nip portion between the feed roller 7 and the retard roller 8, irrespective of the amount of the printing sheets 4 on the sheet tray 163. Therefore, it is possible to prevent the printing sheet 4 from abutting against the surface of the feed roller 7 or the retard roller 8, and to prevent the tip of the printing sheet 4 from being bent or the like.

Embodiment 4

Figure 9:
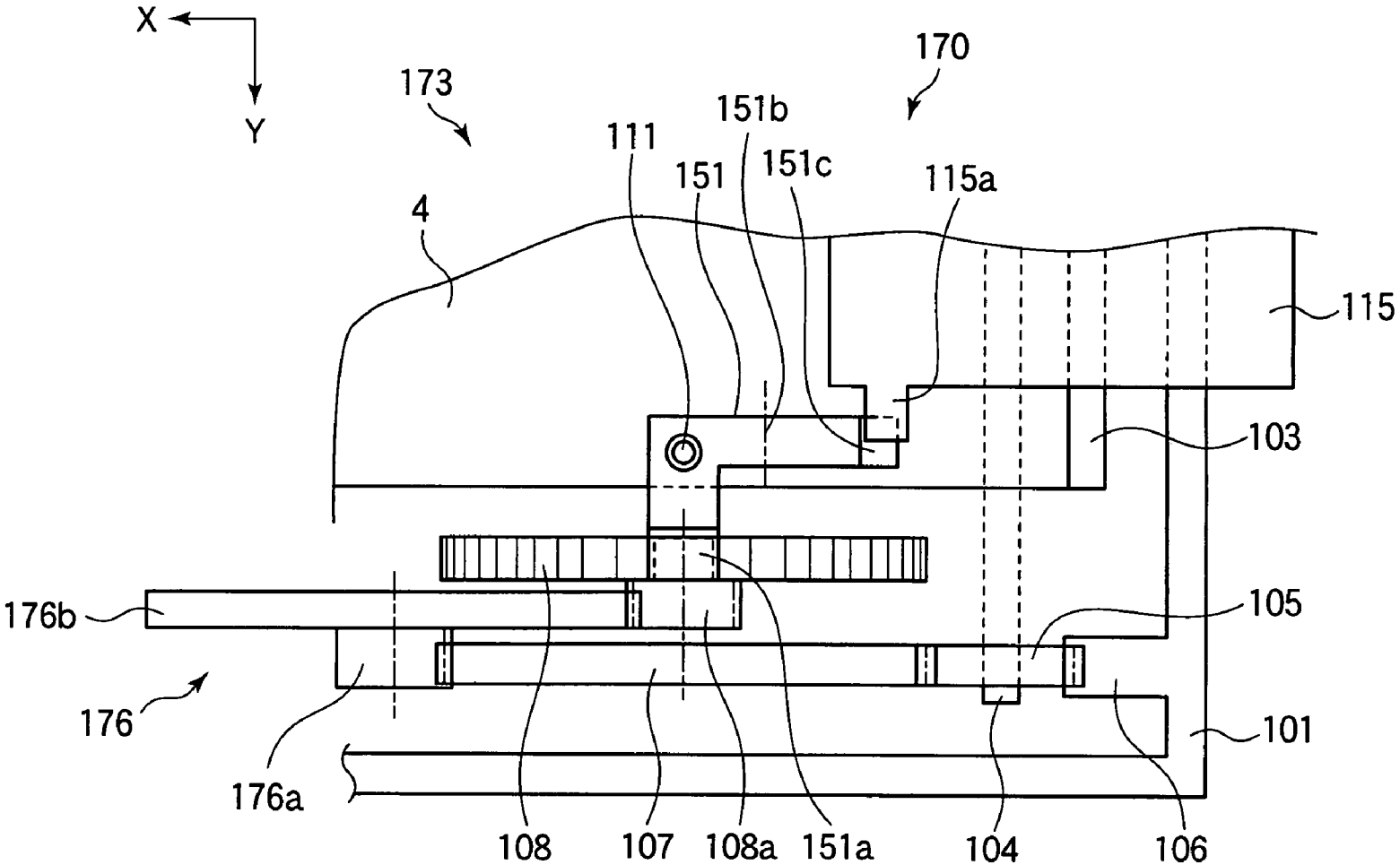
FIG. 9 is a top view showing a structure of a main part of a sheet supplying device according to Embodiment 4.

FIG. 9 is a top view of a main part of a sheet supplying device 170 according to Embodiment 4 of the present invention.

The sheet supplying device 170 is different from the sheet supplying device 150 according to Embodiment 2 (FIG. 5) in that a step-up gear 176 is provided between the sun gear 107 and the ratchet 108. The components of sheet supplying device 170 that are the same as those of the sheet supplying device 150 of Embodiment 2 (FIG. 5) are assigned the same reference numerals, and the duplicate explanation is omitted. The description is emphasized on the difference between the sheet supplying devices 150 and 170.

In the sheet supplying device 170, the planetary gear 105 and the sun gear 107 rotate in accordance with the movement of the sheet placing plate 103 as was described in Embodiment 2. In Embodiment 4, the rotation speed of the ratchet 108 is higher than the rotation speed of the sun gear 107, because of the step-up gear 176 provided between the sun gear 107 and the ratchet 108. The step-up gear 176 includes coaxial small and large gears 176*a* and 176*b*. The ratchet 108 has a coaxial small gear 108 that rotates together with the ratchet 108. The small gear 176*a* of the step-up gear 176 engages the sun gear 107. The large gear 176*b* of the step-up gear 176 engages the small gear 108*a* of the ratchet 108.

As constructed above, the ratchet 108 rotates at a rotation speed higher than the sun gear 107. The ratio (i.e., the step-up ratio) of the rotation speed of the ratchet 108 to that of the sun gear 107 is determined by a gear ratio of the sun gear 107 to the small gear 176*a* of the step-up gear 176, and a gear ratio of the large gear 176*b* of the step-up gear 176 to the small gear 108*a* of the ratchet 108.

Accordingly, the rotating angle of the sheet placing plate 103 (corresponding to the rotation of the ratchet 108 by one pawl) decreases according to the above described step-up ratio. Thus, the upward movement of the sheet placing plate 103 (every time the ratchet 108 rotates by one pawl) becomes finer, and therefore the variation of the feeding position of the printing sheet 4 is reduced.

As described above, according to the sheet supplying device 170 of Embodiment 4, the variation of the feeding position of the printing sheet 4 becomes finer, compared with Embodiment 2. Thus, it becomes possible to precisely control the operation (moving and stopping) of the sheet placing plate 3, and to stably feed of the printing sheet 4 out of a sheet tray 173 .

In Embodiment 4, the step-up gear 176 is added to the sheet supplying device 150 described in Embodiment 2. However, the same advantage can be obtained if the step-up gear 176 is added to the sheet supplying device 100 (FIG. 3) described in Embodiment 1. Various modifications can be employed.

Embodiment 5

Figure 10:
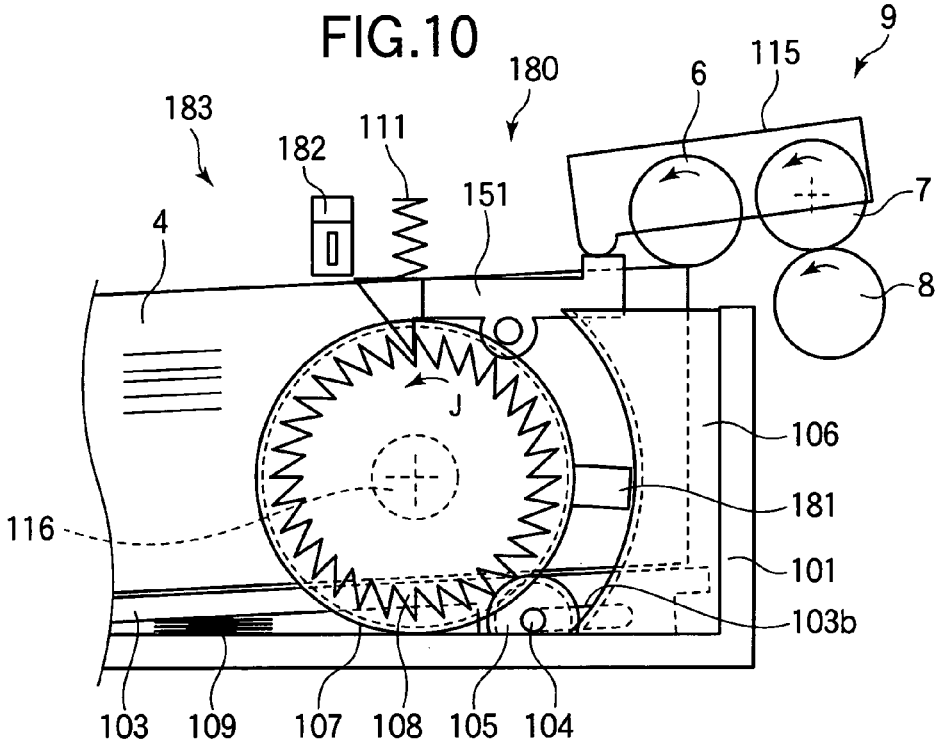
FIG. 10 is a side view showing a structure and an operation of a main part of a sheet supplying device according to Embodiment 5.
Figure 11:
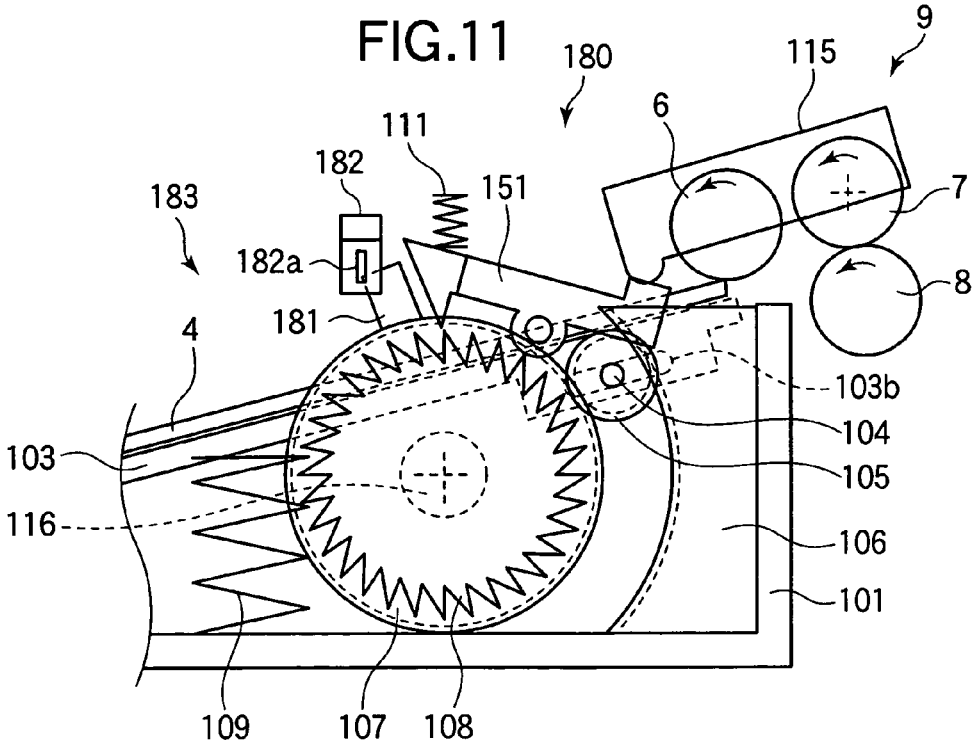
FIG. 11 is a side view showing the structure and the operation of the main part of the sheet supplying device according to Embodiment 5.

FIGS. 10 and 11 respectively show a structure and an operation of a sheet supplying device 180 according to Embodiment 5 of the present invention.

Different from the sheet supplying device 150 of Embodiment 2 (FIG. 5), the sheet supplying device 180 of Embodiment 5 has a protrusion 181 formed on the sun gear 107 and a printing sheet remaining amount sensor 182 provided on the image forming apparatus 1 (FIG. 1) to detect the protrusion 181. The components of sheet supplying device 180 that are the same as those of the sheet supplying device 150 of Embodiment 2 (FIG. 5) are assigned the same reference numerals, and the duplicate explanation is omitted. The description is emphasized on the difference between the sheet supplying devices 150 and 180.

FIG. 10 shows a condition in which the amount of the printing sheets 4 on a sheet tray 183 is the maximum. FIG. 11 shows a condition in which the amount of the printing sheets 4 on the sheet tray 183 is almost the minimum. The operation of the sheet supplying device 180 from the condition of FIG. 10 to the condition of FIG. 11 is the same as that of the sheet supplying device 150 (FIG. 5) of Embodiment 2, and therefore the duplicate explanation is omitted.

When the printing sheets 4 on the sheet tray 183 is the maximum, the protrusion 181 formed on the sun gear 107 is located at a position in which the protrusion 181 is not detected by the printing sheet remaining amount sensor 182. In this state, the printing sheets 4 are fed out of the sheet tray 183, and the amount of the printing sheets 4 on the sheet tray 183 decreases. As the amount of the printing sheets 4 on the sheet tray 183 decreases, the sun gear 107 rotates in the direction shown by the arrow J in FIG. 10, and the protrusion 181 moves in accordance with the rotation of the sun gear 107. As the amount of the printing sheets 4 on the sheet tray 183 becomes almost the minimum, the protrusion 181 is detected by a detecting portion 182*a* of the printing sheet remaining amount sensor 182. Then, the printing sheet remaining amount sensor (i.e., the position sensor) 182 sends the detection signal to the print controller 62 (FIG. 2).

When the print controller 62 receives the detection signal from the printing sheet remaining amount sensor 182, the print controller 62 determines that the amount of the printing sheets 4 on the sheet tray 183 decreases to the predetermined amount, and displays a caution (i.e., an information) about the remaining amount of the printing sheets 4 on the display panel (i.e., the display unit) 63*a* of the operating portion 63 (FIG. 2).

As described above, according to the sheet supplying device 180, the remaining amount of the printing sheets 4 can be detected based on the rotating angle of the ratchet 108 or the sun gear 107. It is not necessary to directly detect the printing sheets 4 on the sheet placing plate 103. Therefore, the freedom in design of the sheet supplying device 180 increases, and the structure of the sheet supplying device 180 becomes simple. Further, the manufacturing cost is reduced.

In Embodiment 5, the protrusion 181 of the sun gear 107 and the printing sheet remaining amount sensor 182 are added to the sheet supplying device 150 of Embodiment 2. However, the same advantage can be obtained if the protrusion 181 of the sun gear 107 and the printing sheet remaining amount sensor 182 are added to the sheet supplying device 100 of Embodiment 1. Various modifications can be employed.

While the preferred embodiments of the present invention have been illustrated in detail, it should be apparent that modifications and improvements may be made to the invention without departing from the spirit and scope of the invention as described in the following claims.

What is claimed is:

1. A sheet supplying device comprising:

a main body;

an engaging member provided on said main body;

a sheet placing member on which printing sheets are placed, said sheet placing member being supported by said main body so that said sheet placing member is able to move upward and downward;

a feeding unit supported by said main body, said feeding unit being shiftable in accordance with an amount of printing sheets placed on said sheet placing member, said feeding unit contacting and feeding said printing sheet out of said sheet placing member;

an urging member supported by said main body, said urging member resiliently urging said sheet placing member toward said feeding unit;

a first rotating unit that engages said engaging member provided on said main body and moves according to the movement of said sheet placing member while rotating;

a second rotating unit that contacts said first rotating unit and rotates so that said first rotating unit in contact with said second rotating unit moves around said second rotating unit while rotating;

a restricting unit movably supported by said main body, said restricting unit being configured to restrict the movement of said first rotating unit by stopping the rotation of said second rotating unit, and allows the movement of said first rotating unit by allowing the rotation of said second rotating unit in accordance with a shifting of said feeding unit; and a movement control unit that controls the movement of said restricting unit, wherein said sheet placing member moves upward when said restricting unit releases the restriction of the movement of said first rotating unit, and stops moving upward when said restricting unit restricts the movement of said first rotating unit.

2. The sheet supplying device according to claim 1, further comprising a tray frame attached to said main body, wherein said tray frame supports said sheet placing member, said urging member and said engaging member.

3. The sheet supplying device according to claim 2, wherein said second rotating unit has a ratchet rotatably supported by said tray frame, wherein said ratchet rotates in accordance with the movement of said sheet placing member, and engages said restricting unit so that the movement of said sheet placing member is restricted.

4. The sheet supplying device according to claim 3, wherein said engaging member is an internally-toothed rack fixed to said tray frame, wherein said first rotating unit comprises a planetary gear rotatably supported by said sheet placing member so that said planetary gear engages said internally-toothed rack, wherein said second rotating unit comprises a sun gear rotatably supported by said tray frame so that said sun gear engages said planetary gear and rotates in accordance with the rotation of said planetary gear, and wherein said ratchet rotates in accordance with the rotation of said sun gear, and includes pawls formed on a circumference of a circle whose center is aligned with a rotation axis of said ratchet.

5. The sheet supplying device according to claim 4, further comprising a step-up gear that transmits the rotation of said sun gear to said ratchet so that the rotation speed of said ratchet is higher than the rotation speed of said sun gear.

6. The sheet supplying device according to claim 4, wherein said rotation axis of said ratchet is shifted from a rotation center of said sun gear.

7. The sheet supplying device according to claim 1, wherein said movement control unit comprises:

a position detecting member that detects the position of said feeding unit;

a moving unit that moves said engaging member, and a controller that controls the movement of said moving unit.

8. The sheet supplying device according to claim 7, wherein said moving unit includes a solenoid having a movable plunger.

9. The sheet supplying device according to claim 1, wherein said movement control unit includes a driving force transmission mechanism that contacts said feeding unit and drives said engaging member in accordance with the movement of said feeding unit.

10. The sheet supplying device according to claim 3, wherein said feeding unit comprises:

a pickup roller that contacts said printing sheet, and a pickup frame that rotatably supports said pickup roller, said pickup frame having a pressing portion that moves in accordance with the position of said pickup roller, wherein said restricting unit comprises:

a rotatable member rotatably supported by said tray frame, and a claw provided on said rotatable member, said claw being able to engage said ratchet, wherein said movement control unit comprises a driving force transmission mechanism that contacts said feeding unit and drives said engaging member in accordance with the movement of said feeding unit, and wherein said movement control unit includes a contact portion integrally formed on said rotatable member that contacts said pressing portion of said pickup frame.

11. The sheet supplying device according to claim 1, wherein said rotating unit comprises:

a movable member that moves in accordance with the upper movement of said sheet placing member, and a force generation unit that generates a force applied to said movable member in a direction opposite to a direction in which said movable member moves.

12. The sheet supplying device according to claim 1, further comprising:

a position sensor that detects the position of said driven unit and outputs a positional information signal, and a display unit that displays an information about the remaining amount of said printing sheets according to said positional information.

13. An image forming apparatus comprising:

said sheet supplying device according to claim 1, and an image forming unit that forms an image on said printing sheet fed by said sheet supplying device.

14. The sheet supplying device according to claim 1, wherein said restricting unit is disposed above said second rotating unit.

* * * * *